US008246215B2

(12) United States Patent
Lu et al.

(10) Patent No.: US 8,246,215 B2
(45) Date of Patent: Aug. 21, 2012

(54) LED BULB

(75) Inventors: Ying-Chieh Lu, Miao-Li Hsien (TW); Kuo-Feng Chiang, Miao-Li Hsien (TW); Zheng-Jay Huang, Miao-Li Hsien (TW); Ying-Ching Chen, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 135 days.

(21) Appl. No.: 12/795,856

(22) Filed: Jun. 8, 2010

(65) Prior Publication Data

US 2011/0291542 A1 Dec. 1, 2011

(30) Foreign Application Priority Data

May 26, 2010 (TW) ..... 99116742 A

(51) Int. Cl.
*F21V 29/00* (2006.01)

(52) U.S. Cl. ..... 362/294; 362/249.02; 362/373

(58) Field of Classification Search ..... 362/294, 362/373, 249.01, 249.02, 311.02; 361/701–703
See application file for complete search history.

(56) References Cited

U.S. PATENT DOCUMENTS

| | | | | |
|---|---|---|---|---|
| 7,524,089 | B2 * | 4/2009 | Park | 362/294 |
| 7,631,987 | B2 * | 12/2009 | Wei | 362/294 |
| 7,748,870 | B2 * | 7/2010 | Chang et al. | 362/294 |
| 7,800,119 | B2 * | 9/2010 | He et al. | 257/79 |
| 7,871,184 | B2 * | 1/2011 | Peng | 362/294 |
| 7,874,699 | B2 * | 1/2011 | Liang | 362/249.02 |
| 7,918,587 | B2 * | 4/2011 | Hsu et al. | 362/294 |
| 8,057,075 | B2 * | 11/2011 | Horng et al. | 362/373 |
| 8,143,769 | B2 * | 3/2012 | Li | 313/46 |
| 2005/0174780 | A1 * | 8/2005 | Park | 362/294 |
| 2007/0285926 | A1 * | 12/2007 | Maxik | 362/294 |
| 2010/0103666 | A1 * | 4/2010 | Chang et al. | 362/234 |
| 2010/0110699 | A1 * | 5/2010 | Chou | 362/365 |
| 2010/0232168 | A1 * | 9/2010 | Horng et al. | 362/373 |
| 2011/0089838 | A1 * | 4/2011 | Pickard et al. | 315/113 |
| 2011/0090686 | A1 * | 4/2011 | Pickard | 362/235 |

* cited by examiner

*Primary Examiner* — John A Ward
(74) *Attorney, Agent, or Firm* — Altis Law Group, Inc.

(57) ABSTRACT

An LED bulb includes a connector for electrically connecting with a power supply, a heat sink disposed on the connector, and a plurality of LEDs mounted the heat sink. The heat sink includes a base, a tube extending downwardly from a first face of the base, and a plurality of fins extending outwardly from an outer circumference of the tube. The LEDs are attached on a second face of the base. The base defines a plurality of through tunnels extending through the base from the first face to the second face of the base.

14 Claims, 4 Drawing Sheets

LED BULB

BACKGROUND

1. Technical Field

The disclosure relates to LED (light emitting diode) bulbs for illumination purpose and, more particularly, relates to an improved LED bulb having a good heat dissipation.

2. Description of Related Art

An LED bulb is a type of solid-state lighting that utilizes LEDs as a light source for indoor or outdoor illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED bulb is intended to be a cost-effective yet high quality illumination device.

An LED bulb generally requires a plurality of LEDs mostly driven at the same time, which results in a rapid rise in operating temperature of the LEDs. However, since the bulbs lack effective heat dissipation mechanisms, continuous operation of the LED bulbs can cause overheat of the LEDs, resulting in flickering or even malfunction of the LEDs.

What is needed, therefore, is an improved LED bulb which can overcome the above problems.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
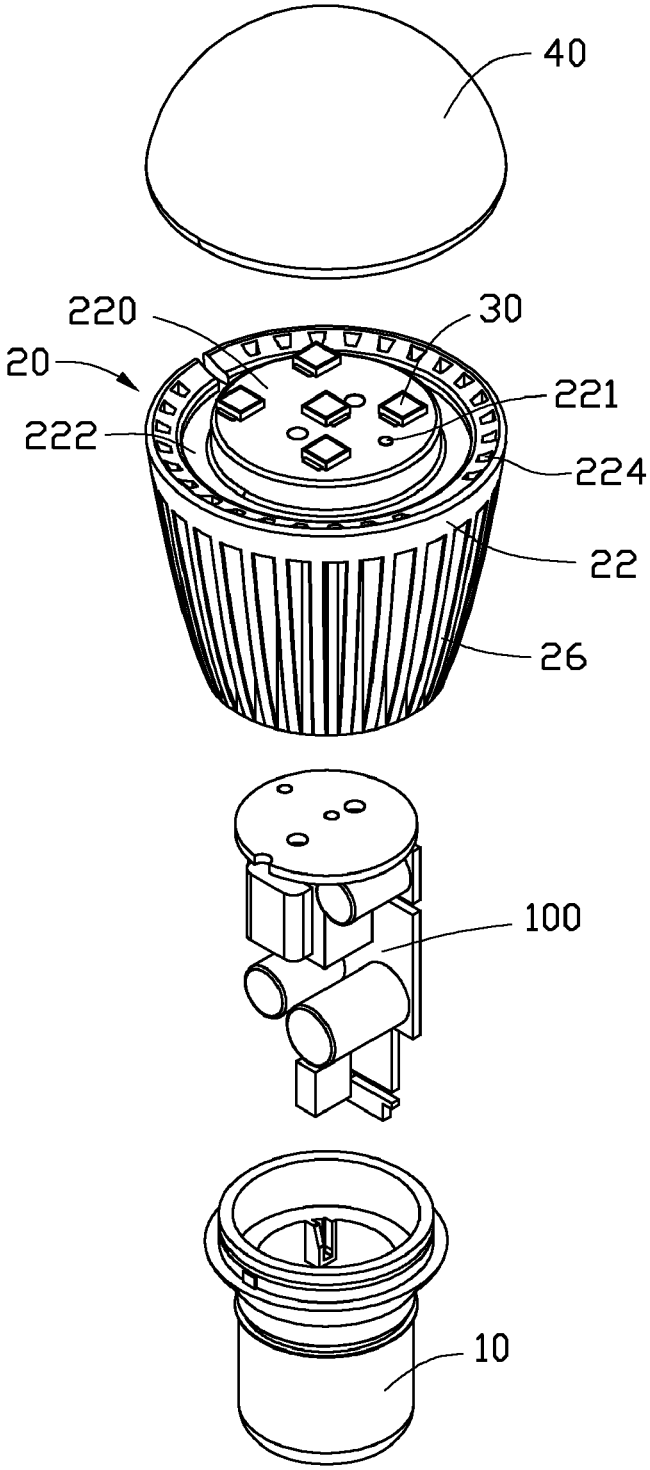
FIG. 1 is an exploded view of an LED bulb in accordance with an embodiment of the disclosure.

Referring to FIG. 1, a light emitting diode (LED) bulb in accordance with an embodiment of the disclosure is illustrated. The LED bulb comprises a connector 10, a heat sink 20 disposed on the connector 10, a plurality of LEDs 30 mounted on the heat sink 20, and an envelope 40 secured to the heat sink 20 and covering the LEDs 30.

The connector 10 is electrically connected with a power supply. The connector 10 is a standard cap which can be suited with conventional lamp sockets.

Figure 2:
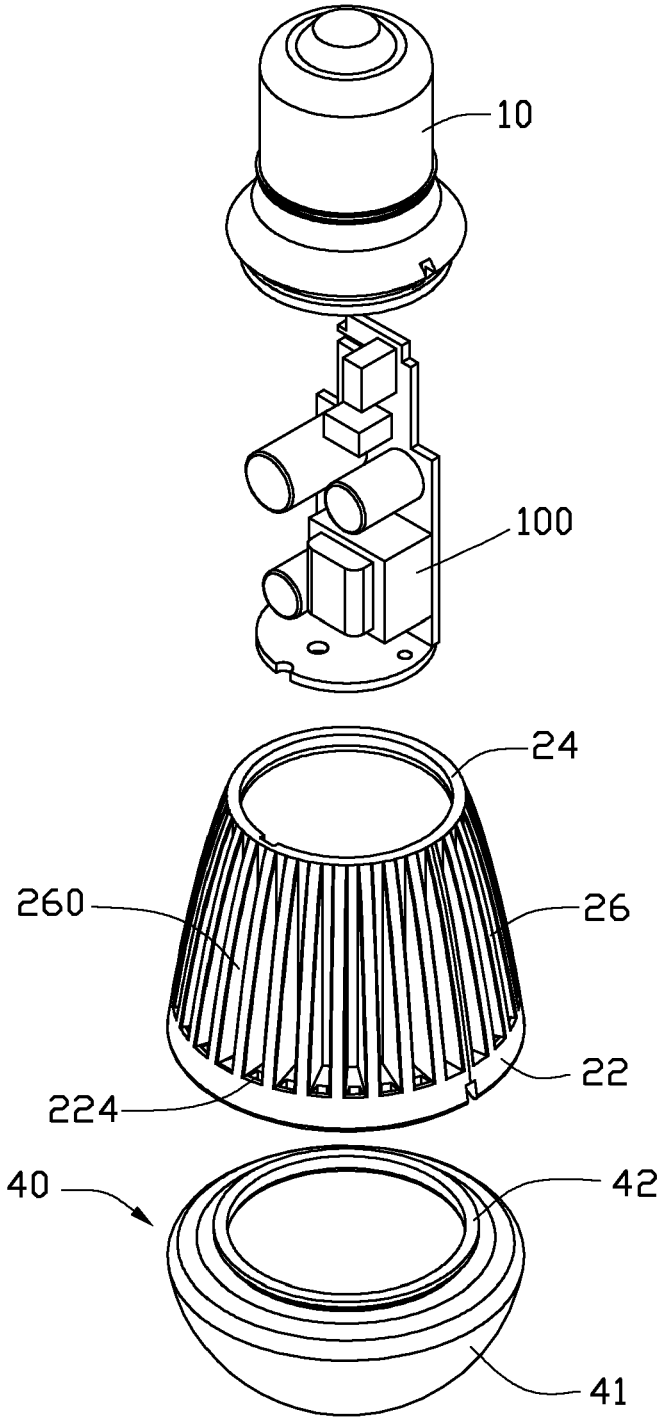
FIG. 2 is an inverted view of the LED bulb of FIG. 1.
Figure 3:
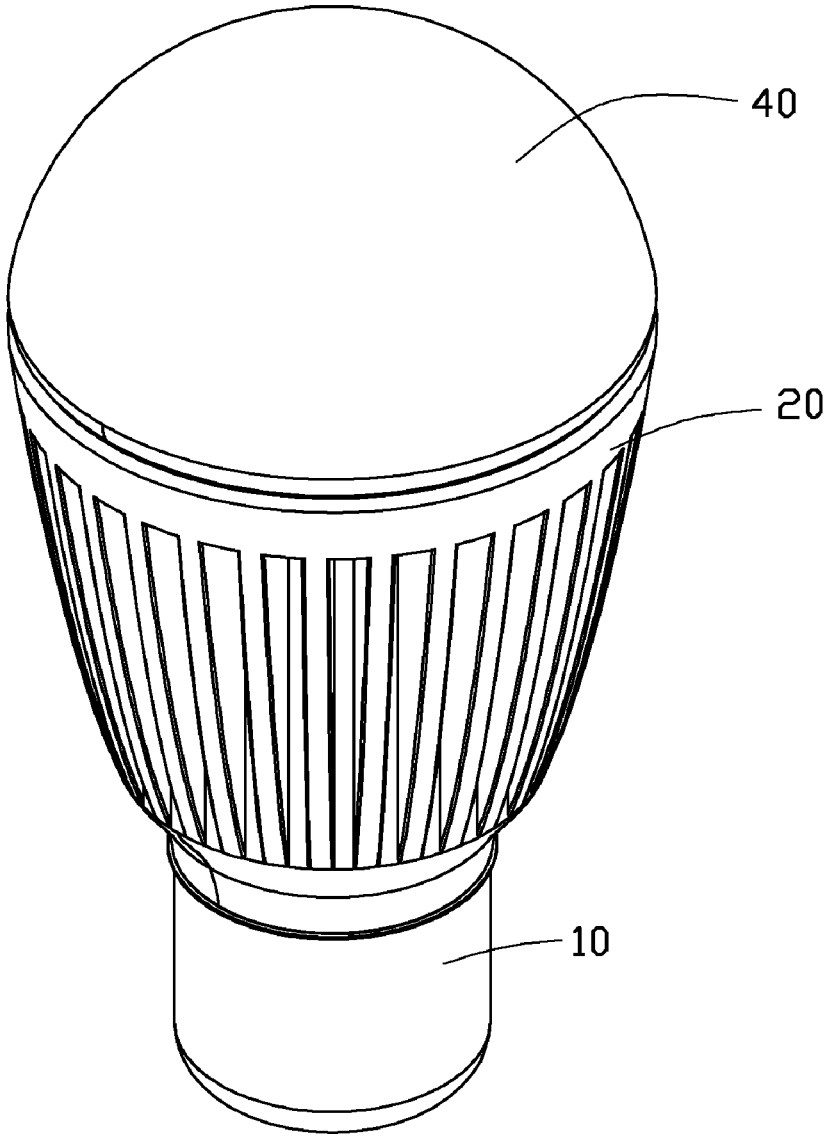
FIG. 3 is an assembled view of the LED bulb of FIG. 1.
Figure 4:
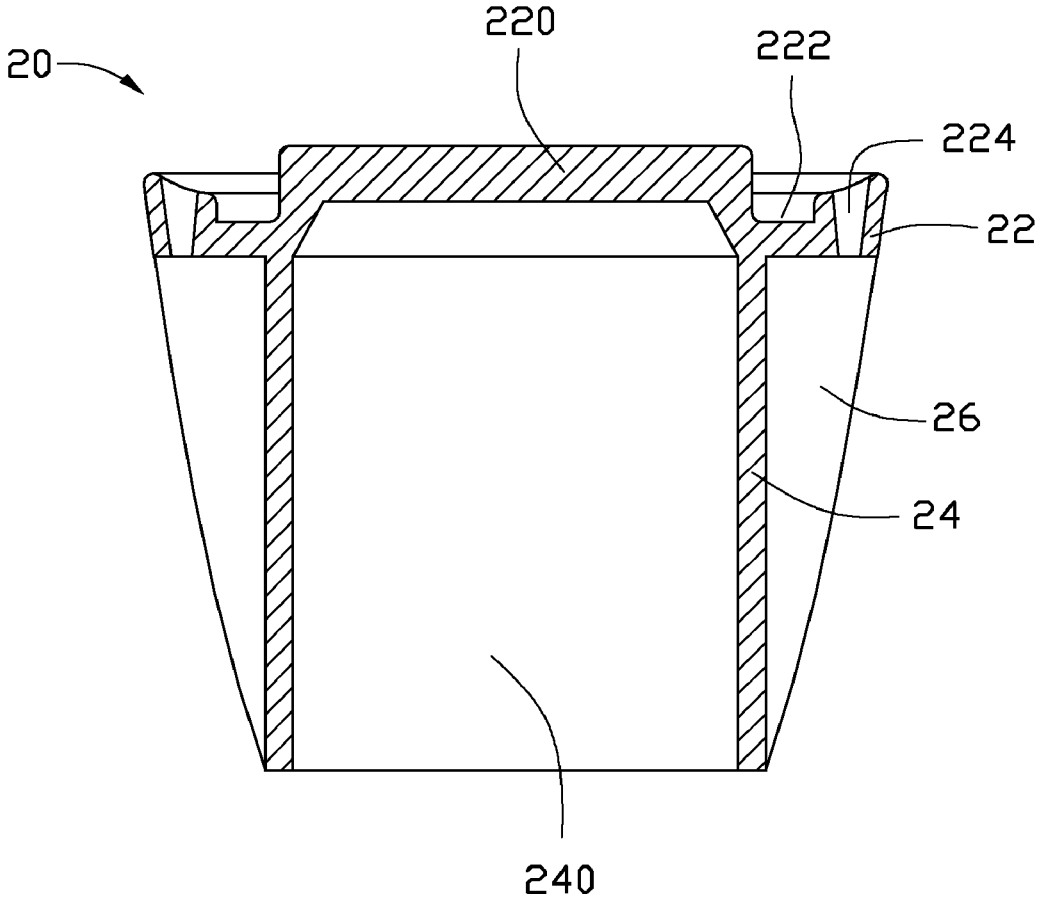
FIG. 4 shows a cross sectional view of a heat sink of the LED bulb of FIG. 1.

Referring to FIGS. 2-4 also, the heat sink 20 is integrally made of ceramic with good heat conductivity and electric insulation capability. The ceramic is made from materials selected from alumina, silicate, oxide, carbide, nitride, sulfide and boride. The heat sink 20 comprises a circular base 22, a tube 24 extending downwardly from a bottom face of the base 22, and a plurality of fins 26 extending outwardly from an outer circumference of the tube 24. A top face of the base 22 is concaved downwardly to form a depression. A protrusion 220 is protruded upwardly from a central area of the top face of the base 22. The protrusion 220 has a flat top face on which the LEDs 30 are attached. A plurality of through holes 221 are defined in the top face of the protrusion 220 for extension of electrical wires (not shown) therethrough to electrically connect with the LEDs 30. An annular receiving groove 222 is defined along an outer periphery of the protrusion 220 for receiving a portion of the envelope 40 therein. The tube 24 extends perpendicularly and downwardly from a center of the bottom face of the base 22. A diameter of the tube 24 is less than that of the base 22. The fins 26 are spaced from each other. The fins 26 are arranged radially relative to the tube 24. A passage 260 is defined between every two neighboring fins 26. The fins 26 directly connect with the bottom face of the base 22. The tube 24 defines a cavity 240 at a center thereof, for accommodating a driving module 200 therein. A distal end of the tube 24 is engaged with the connector 10.

A plurality of through tunnels 224 are defined in the base 22. Each of the through tunnels 224 extends through the base 22 and has two openings (not labeled) at the top face and the bottom face of the base 22, respectively. The through tunnels 224 are arranged radially relative to the protrusion 220 and the tube 24. The openings of the through tunnels 224 which are located at the top face of the base 22 surround the receiving groove 222. The openings of the through tunnels 224 which are located at the bottom face of the base 22 surround the tube 24. Each of the openings of the through tunnels 224, which is located at the bottom face of the base 22, is located correspondingly between two adjacent fins 26. In other words, each of the through tunnels 224 is communicated with a corresponding passage 260 of the fins 26. Each of the through tunnels 224 is tapered from the top face towards the bottom face of the base 22. The through tunnels 224 are located adjacent an outer periphery of the base 22.

The LEDs 30 are thermally attached on the top face of the protrusion 220 of the base 22. The LEDs 30 are spaced from each other and evenly arranged on the protrusion 220.

The envelope 40 is integrally formed of a transparent or semitransparent material such as glass, resin or plastic. The envelope 40 comprises a bowl-shaped body 41 and an annular engaging flange 42 protruding outwardly from a bottom of the body 41 towards the base 22. The engaging flange 42 is fitly received in the receiving groove 222 of the base 22 of the heat sink 20, whereby the envelope 40 is hermetically mounted on the base 22 and cooperates with the base 22 to enclose the LEDs 30 therein for increasing the sealing performance of the LED bulb. Furthermore, the envelope 40 can function to modulate the light generated by the LEDs 30 to have a desired pattern. The tunnels 224 communicate the top face of the base 22 of the heat sink 20 and the passages 260, whereby the heat generated by the LEDs 30 can be more easily dissipated to the surrounding air of the LED bulb in accordance with the present disclosure, since a natural heat convection can be more easily formed through the heat sink 20 when the LED bulb is activated to emit light.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED bulb comprising:

a connector for being electrically connected to a power supply;

a heat sink disposed on the connector, the heat sink comprising a base, a tube extending downwardly from a first face of the base to engage with the connector, and a plurality of fins extending outwardly from an outer circumference of the tube; and a plurality of LEDs mounted a second face of the base;

wherein the base defines a plurality of through tunnels extending through the base from the first face to the second face of the base;

wherein the fins are spaced from each other, and an airflow passage is defined between every two adjacent fins; and wherein each of the through tunnels is aligned with and directly communicated with a corresponding passage.

2. The LED bulb as described in claim 1, wherein the through tunnels expands from the first face to the second face of the base.

3. The LED bulb as described in claim 1, wherein the through tunnels are located adjacent an outer periphery of the base.

4. The LED bulb as described in claim 1, wherein the through tunnels are spaced from each other.

5. The LED bulb as described in claim 1 further comprising an envelope mounted on the base, and the envelope cooperates with the base to enclose the LEDs therein.

6. The LED bulb as described in claim 5, wherein the envelope comprises a bowl-shaped body, and an annular engaging flange extending from the body and protruding downwardly towards the base.

7. The LED bulb as described in claim 6, wherein an annular receiving groove is defined on the second face of the base, for receiving the engaging flange of the envelope therein.

8. The LED bulb as described in claim 7, wherein the through tunnels surround the receiving groove of the base.

9. The LED bulb as described in claim 1, wherein fins are arranged radially relative to the tube.

10. The LED bulb as described in claim 1, wherein the heat sink is integrally made of a ceramic.

11. The LED bulb as described in claim 10, wherein the ceramic is made from materials selected from alumina, silicate, oxide, carbide, nitride, sulfide and boride.

12. The LED bulb as described in claim 1, wherein the second face of the base is concaved downwardly to form a depression.

13. The LED bulb as described in claim 12, wherein a protrusion is protruded upwardly from a central area of the second face of the base, and the protrusion has a flat face on which the LEDs are attached.

14. The LED bulb as described in claim 1, wherein the fins directly connect with the first face of the base.

* * * * *